US011179937B2

(12) United States Patent
Hayashi

(10) Patent No.: US 11,179,937 B2
(45) Date of Patent: Nov. 23, 2021

(54) LIQUID DISCHARGE HEAD

(71) Applicant: Brother Kogyo Kabushiki Kaisha, Nagoya (JP)

(72) Inventor: Hideki Hayashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 132 days.

(21) Appl. No.: 16/712,565

(22) Filed: Dec. 12, 2019

(65) Prior Publication Data

US 2020/0238703 A1 Jul. 30, 2020

(30) Foreign Application Priority Data

Jan. 28, 2019 (JP) ..... JP2019-012431

(51) Int. Cl.
*B41J 2/14* (2006.01)

(52) U.S. Cl.
CPC ..... *B41J 2/14233* (2013.01)

(58) Field of Classification Search
CPC ..... B41J 2/14072; B41J 2202/18
See application file for complete search history.

(56) References Cited

U.S. PATENT DOCUMENTS

2008/0238980 A1* 10/2008 Nagashima ..... B41J 2/14233 347/17
2012/0176450 A1 7/2012 Akahane et al.
2018/0086069 A1* 3/2018 Kakiuchi ..... H01L 41/09

FOREIGN PATENT DOCUMENTS

JP 2015-134507 A 7/2015

* cited by examiner

*Primary Examiner* — Scott A Richmond
(74) *Attorney, Agent, or Firm* — Banner & Witcoff, Ltd.

(57) ABSTRACT

There is provided a liquid discharge head including: a channel member including individual channels that include nozzles and pressure chambers communicating with the nozzles and at least part of a first common channel communicating with the individual channels; a vibration plate overlapping in a first direction with the channel member and covering the pressure chambers; driving elements placed on a surface of the vibration plate at a side opposite to the pressure chambers in the first direction; and a protection substrate disposed on the surface of the vibration plate, where the driving elements are placed, at the side opposite to the pressure chambers and covering the driving elements, wherein the protection substrate includes a second common channel that is common to the individual channels and the channel member includes a connection channel connecting the individual channels and the second common channel.

20 Claims, 9 Drawing Sheets

LIQUID DISCHARGE HEAD

CROSS REFERENCE TO RELATED APPLICATION

The present application claims priority from Japanese Patent Application No. 2019-012431 filed on Jan. 28, 2019, the disclosure of which is incorporated herein by reference in its entirety.

BACKGROUND

Field of the Invention

The present disclosure relates to a liquid discharge head configured to discharge a liquid from nozzles.

Description of the Related Art

As an exemplary liquid discharge head discharging a liquid from nozzles, there is known an ink-jet head discharging ink from nozzles. In the publicly known ink-jet head, a nozzle plate formed having the nozzles, a communicating path plate formed having communicating paths, and a channel plate formed having pressure chambers and ink supply paths are stacked on top of each other. In that configuration, individual channels are formed in a stacked body formed by the nozzle plate, the communicating path plate, and the channel plate. Each individual channel includes the nozzle, the communicating channel, the pressure chamber, and the ink supply channel. The pressure chambers are covered with an elastic film disposed on an upper surface of the channel plate. Driving elements formed by a piezoelectric body layer and electrodes are disposed on an upper surface of the electric film. The driving elements are covered with a protection substrate disposed on the upper surface of the elastic film.

In the above ink-jet head, ink is supplied from a manifold formed by the channel plate, the protection substrate, and a case member to the individual channels. Further, ink is discharged from the individual channels to a circulation channel formed in the communication path plate and the channel plate.

SUMMARY

In the above ink-jet head, the circulation channel is formed in the communicating path plate formed having the communicating paths and the channel plate formed having the pressure chambers. This reduces the rigidity of the stacked body formed by the nozzle plate, the communicating path plate, and the channel plate compared to a configuration in which no circulation channel is formed in the communicating path plate and the channel plate. The stacked body is thus easily damaged.

An object of the present disclosure is to provide a liquid discharge head having good rigidity in which two common channels are connected to individual channels.

According to an aspect of the present disclosure, there is provided a liquid discharge head, including: a channel member including: a plurality of individual channels that include a plurality of nozzles and a plurality of pressure chambers communicating with the nozzles; and at least part of a first common channel communicating with the individual channels; a vibration plate overlapping in a first direction with the channel member and covering the pressure chambers that form the individual channels; a plurality of driving elements placed on a surface of the vibration plate at a side opposite to the pressure chambers in the first direction and configured to apply pressure to a liquid in the pressure chambers; and a protection substrate disposed on the surface of the vibration plate, where the driving elements are placed, at the side opposite to the pressure chambers in the first direction and covering the driving elements. The protection substrate includes a second common channel that is common to the individual channels. The channel member includes a connection channel connecting the individual channels and the second common channel.

DESCRIPTION OF THE EMBODIMENTS

An embodiment of the present disclosure is explained below.

Schematic Configuration of Printer 1

Figure 1:
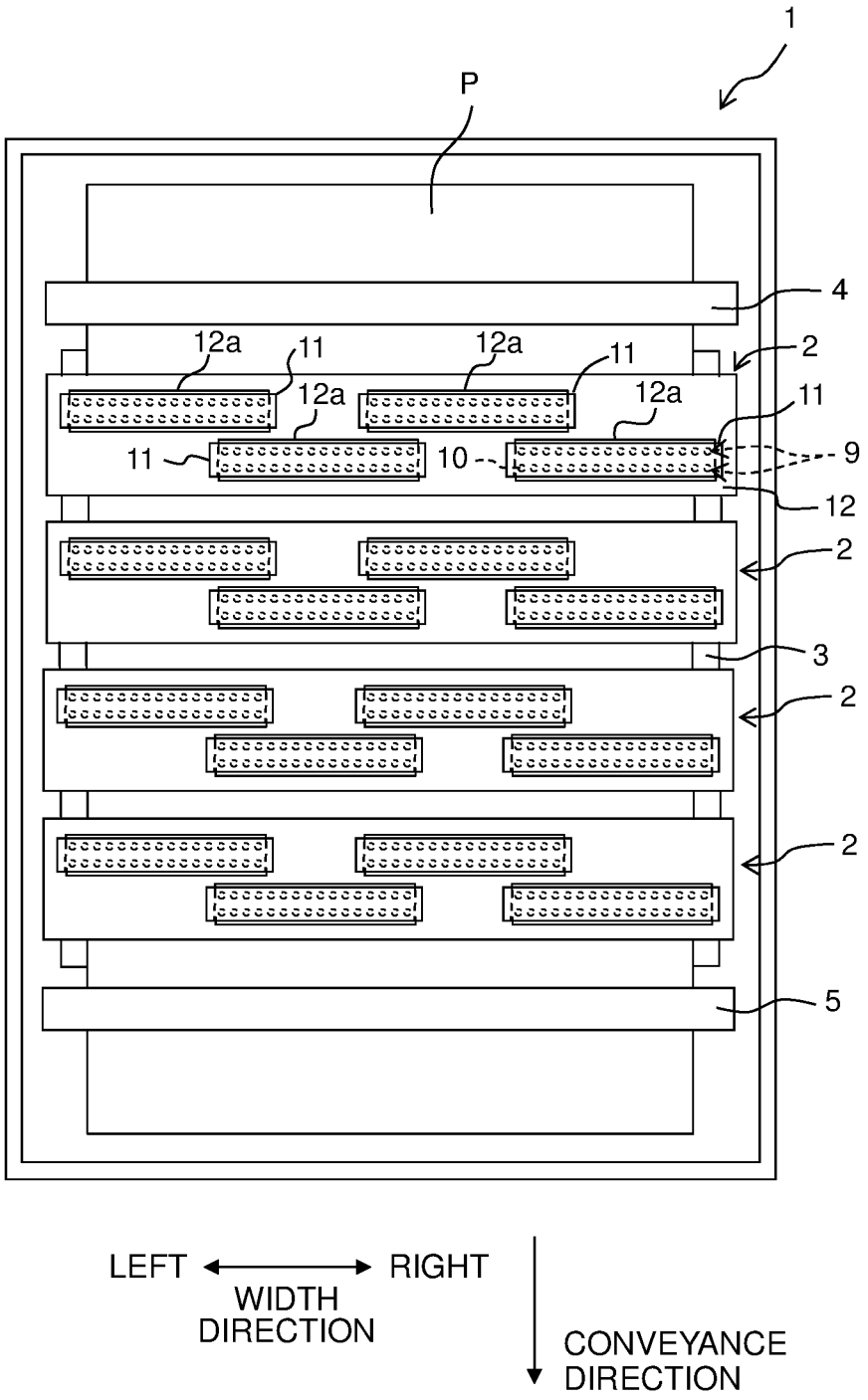
FIG. 1 schematically depicts a configuration of a printer 1.

As depicted in FIG. 1, a printer 1 according to this embodiment includes four ink-jet heads 2, a platen 3, and conveyance rollers 4 and 5.

The four ink-jet heads 2 are arranged in a horizontal conveyance direction (a third direction of the present disclosure) in which a recording sheet P is conveyed by use of the conveyance rollers 4 and 5. Each ink-jet head 2 includes four head units 11 (a liquid discharge head of the present disclosure) and a holding member 12. Each head unit 11 discharges ink from nozzles 10 formed in a lower surface thereof. A black ink, yellow ink, cyan ink, and magenta ink are discharged from the nozzles 10 of the head units 11 of the four ink-jet heads 2 in the order of nozzles 10 from an upstream side in the conveyance direction.

Figure 5:
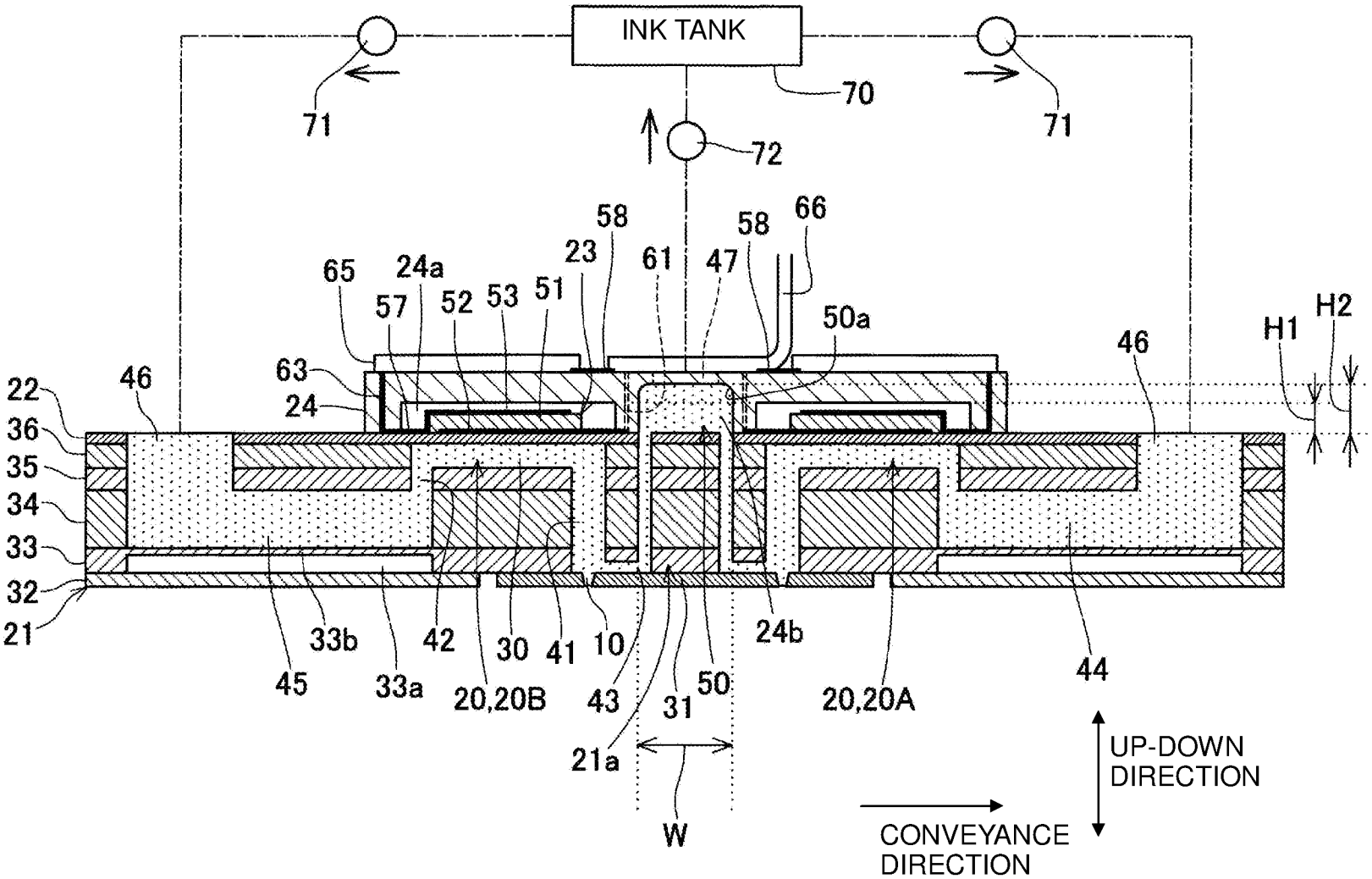
FIG. 5 is a cross-sectional view taken along a line V-V of FIGS. 2 and 3.

In the head unit 11, the nozzles 10 are aligned in a horizontal sheet width direction (a second direction of the present disclosure) to form a nozzle row 9. The sheet width direction is orthogonal to the conveyance direction. The head unit 11 includes two nozzle rows 9 arranged in the conveyance direction. The positions in the sheet width direction of the nozzles 10 belonging to one of the two nozzle rows 9 are different from those belonging to the other by a length corresponding to one-half of an interval between the nozzles 10 in each nozzle row 9. In the following, explanation is made while defining the right and the left in the sheet width direction as indicated in FIG. 1. Further, an up-down direction in this embodiment is defined as indicated in FIG. 5.

In each ink-jet head 2, two of the four head units 11 are arranged in the sheet width direction at an interval. The two head units 11 arranged in the sheet width direction and the remaining two head units 11 are arranged in the conveyance direction at an interval. The positions in the sheet width direction of the two head units 11 arranged at the upstream side in the conveyance direction are shifted from the two head units 11 disposed at the downstream side in the conveyance direction. Some of the nozzles 10 of the head units 11 disposed at the upstream side in the conveyance direction overlap in the conveyance direction with some of the nozzles 10 of the head units 11 disposed at the downstream side in the conveyance direction. This allows the nozzles 10 of the four head units 11 to extend over an entire length in the sheet width direction of the recording sheet P. Namely, each of the ink-jet heads 2 is a so-called line head extending over the entire length in the sheet width direction of the recording sheet P. Details of the head unit 11 are described below.

The holding member 12 is a plate-like rectangular member that is long in the sheet width direction. The four head units 11 are secured to the holding member 12. The holding member 12 has four rectangular through holes 12*a* that respectively correspond to the four head units 11. The nozzles 10 of the head units 11 are exposed to a lower side (recording sheet P side) through the respective through holes 12*a*.

The platen 3, which is disposed below the ink-jet heads 2, faces the nozzles 10 of the four head units 11. The platen 3 supports the recording sheet P from below. The conveyance roller 4 is disposed upstream of the ink-jet heads 2 and the platen 3 in the conveyance direction. The conveyance roller 5 is disposed downstream of the ink-jet heads 2 and the platen 3 in the conveyance direction. The conveyance rollers 4 and 5 convey the recording sheet P in the conveyance direction.

The printer 1 performs recording on the recording sheet P by conveying the recording sheet P in the conveyance direction by use of the conveyance rollers 4 and 5 and discharging ink(s) from the nozzles 10 of the four head units 11.

Head Unit 11

Figure 2:
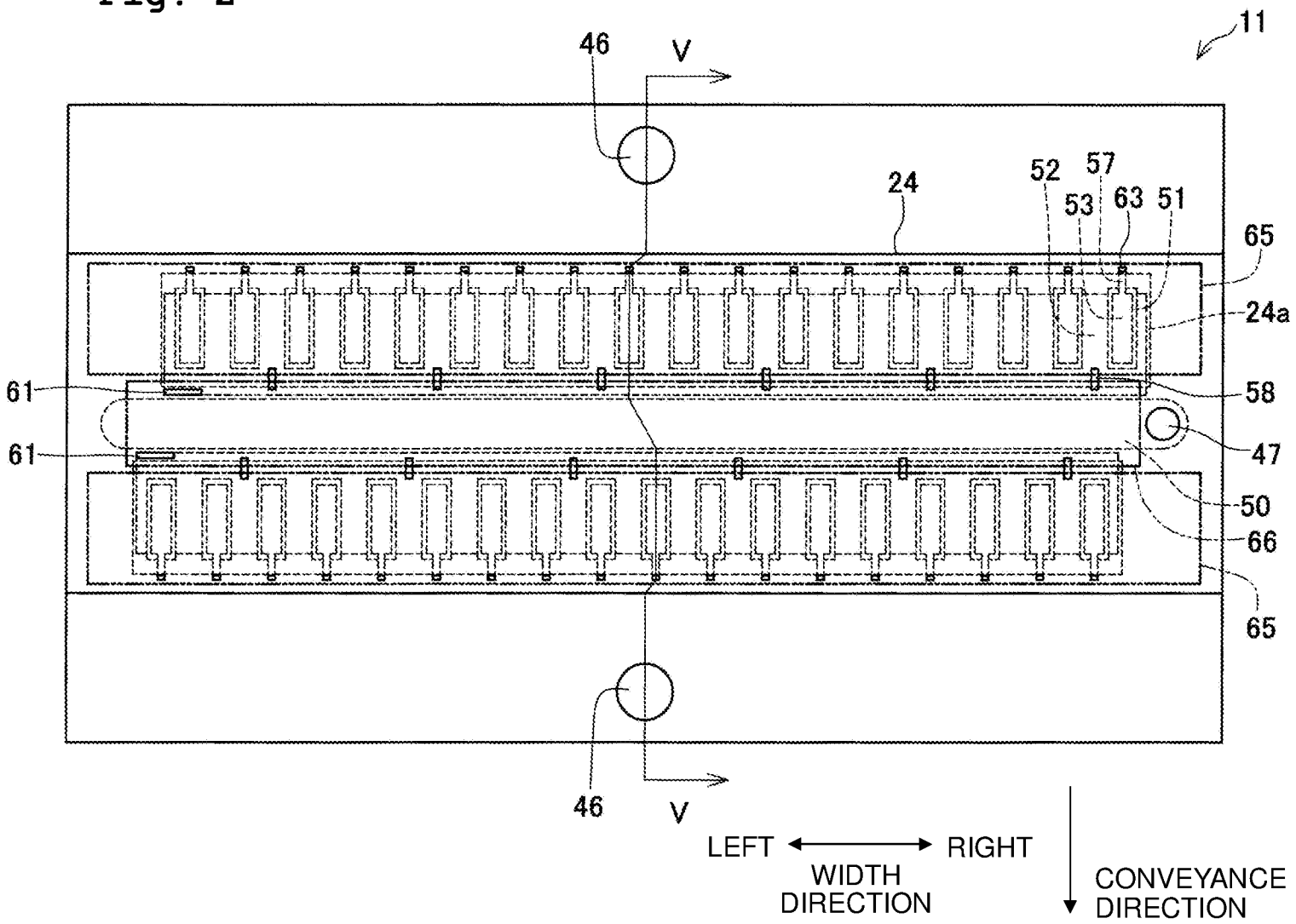
FIG. 2 is a plan view of a head unit 11.
Figure 3:
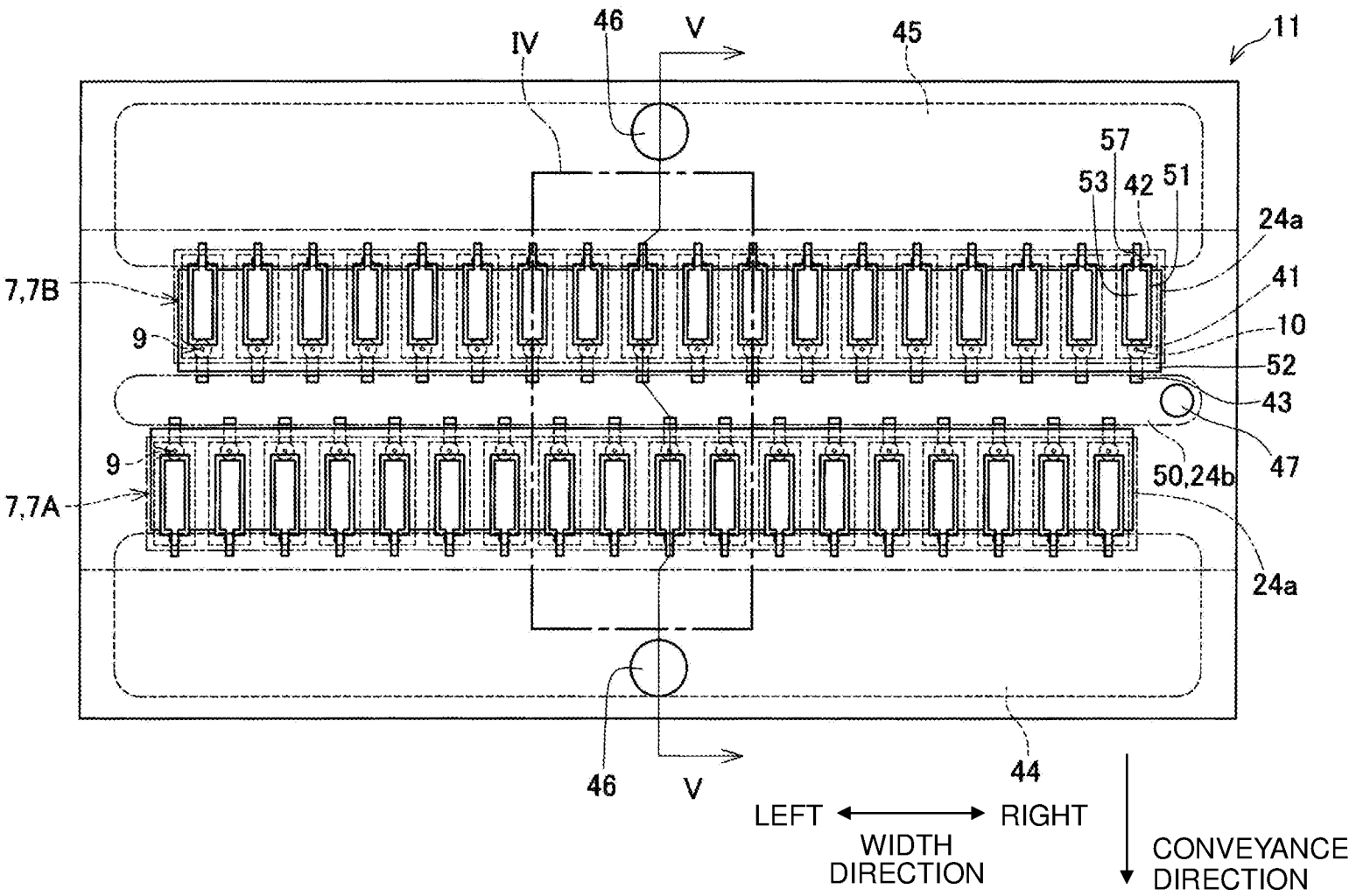
FIG. 3 depicts a positional relationship between, for example, channels and piezoelectric elements, from which a protection substrate 24, drive ICs 65, and a trace member 66 depicted in FIG. 2 are removed.
Figure 4:
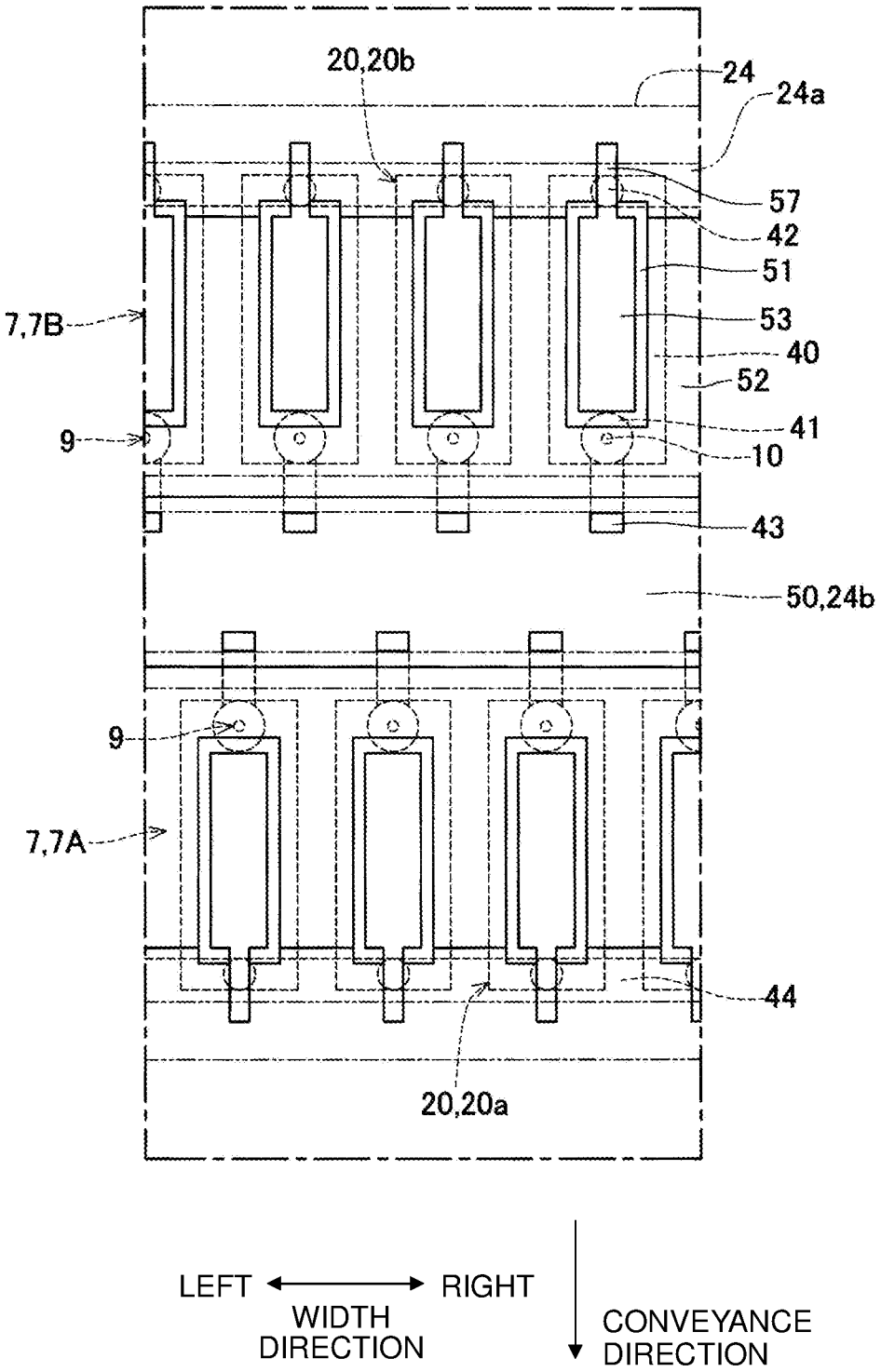
FIG. 4 is an enlarged view of a portion IV of FIG. 3.

Subsequently, the head units 11 are explained in detail. As depicted in FIGS. 2 to 5, each head unit 11 includes a channel unit 21 (a channel member of the present disclosure), a vibration plate 22, piezoelectric elements 23 (a driving element of the present disclosure), and a protection substrate 24. In FIG. 2, driver ICs 65 and trace members are depicted by dot-dot-dash chain lines. In FIGS. 3 and 4, an external form of the protection substrate 24, positions of recesses 24*a* and 24*b* are depicted by dot-dot-dash chain lines.

The channel unit 21 is formed by stacking plates 31 to 36. The plate 31 is made using a synthetic resin material, such as polyimide. The plates 32 and 33 are made, for example, using stainless. The plates 34 to 36 are made, for example, using silicon (Si). The plates 33 to 36 are stacked on top of each other in that order from the bottom. The plate 31 is joined to a center portion of a lower surface of the plate 33. The plate 32 is joined to a portion included in the lower surface of the plate 33 and positioned outside the plate 31 in the conveyance direction.

The channel unit 21 formed by stacking the plates 31 to 36 includes the nozzles 10, pressure chambers 40, descender portions 41, throttle portions 42, connection channels 43, and two first communication channels 44 and 45 (a first common channel of the present disclosure).

The nozzles 10 are formed in the plate 31. The nozzles 10 form the two nozzle rows 9.

The pressure chambers 40 correspond to the respective nozzles 10. The pressure chambers 40 are formed in the plate 36. The shape of the pressure chamber 40 as viewed in the up-down direction (a first direction of the present disclosure) is a rectangle that is long in the conveyance direction. An end at one side in the conveyance direction of the pressure chamber 40 overlaps in the up-down direction with the nozzle 10. More specifically, upstream ends in the conveyance direction of the pressure chambers 40 corresponding to the nozzle row 9 at the downstream side in the conveyance direction overlap in the up-down direction with the nozzles 10. Downstream ends in the conveyance direction of the pressure chambers 40 corresponding to the nozzle row 9 at the upstream side in the conveyance direction overlap in the up-down direction with the nozzles 10.

The descender portions 41 correspond to the respective nozzles 10. The descender portions 41 extend in the up-down direction over the plates 32 to 35. The descender portion 41 connects the nozzle 10 and the pressure chamber 40.

The throttle portions 42 correspond to the respective pressure chambers 40. The throttle portions 42 are formed in the plate 35. The throttle portions 42 overlap in the up-down direction with ends in the conveyance direction of the pressure chambers 40 on the opposite side of the nozzles 10. The throttle portions 42 extend in the up-down direction. Upper ends of the throttle portions 42 are connected to the pressure chambers 40.

The individual channel 20 is formed by one nozzle 10, the pressure chamber 40 corresponding to the one nozzle 10, the descender portion 41, and the throttle portion 42. The channel unit 21 includes two individual channel rows 7 each of which is formed by aligning the individual channels 20 in the sheet width direction. The individual channel rows 7 are arranged in the conveyance direction. In the following, one of the two individual channel rows 7 at the downstream-side in the conveyance direction is referred to as an individual channel row 7A (a first individual channel row of the present disclosure), the other at the upstream-side in the conveyance direction is referred to as an individual channel row 7B (a second individual channel row of the present disclosure). The individual channels 20 forming the individual channel row 7A are referred to as individual channels 20A, and the individual channels 20 forming the individual channel row 7B are referred to as individual channels 20B.

A portion included in the channel unit 21 (plates 33 to 36) and positioned between the individual channel row 7A and the individual channel row 7B is a partition wall 21*a* separating the individual channels 20A from the individual channels 20B.

The connection channels 43 correspond to the descender portions 41. At a lower end of the plate 33, the connection channel 43 is connected to a lower end of the descender portion 41. In the head unit 11, each connection channel 43 extends inward in the conveyance direction from the connection portion with the descender portion 41. The connection channel 43 is bent upward and extends in the up-down direction over the plates 33 to 36 and the vibration plate 22.

The first common channel 44 corresponds to the individual channel row 7A. The first common channel 44 is formed in the plate 34. The first common channel 44 extends in the sheet width direction over the entire length of the individual channel row 7A. An upstream end in the conveyance direction of the first common channel 44 overlaps in the up-down direction with the throttle portions 42 of the individual channels 20A. This causes the lower ends of the throttle portions 42 of the individual channels 20A to be connected to the first common channel 44.

The first common channel 45 corresponds to the individual channel row 7B. The first common channel 45 is formed in the plate 34. The first common channel 45 extends in the sheet width direction over the entire length of the individual channel row 7B. A downstream end in the conveyance direction of the first common channel 45 overlaps in the up-down direction with the throttle portions 42 of the individual channels 20B. This causes the lower ends of the throttle portions 42 of the individual channels 20B to be connected to the first common channel 45. In FIG. 5, all the portions of the first common channels 44 and 45 are formed in the channel unit 21. However, another channel member defining the first common channels 44 and 45 may be provided above the channel unit 21. Namely, at least part of the first common channels 44 and 45 may be formed in the channel unit 21.

Recesses 33*a* are formed in the lower surface of the plate 33 at portions overlapping in the up-down direction with the first common channels 44 and 45. In that configuration, portions of the plate 33 positioned above the recesses 33*a* are dampers 33*b* that are thin and elastically deformable. Pressure variation of ink in the first common channels 44 and 45 is inhibited through elastic deformation of the dampers 33*b*. Openings at the lower side of the recesses 33*a* are closed by the plate 32. In the head unit 11, no plate 32 may be provided so that the dampers 33*b* are exposed to the lower side.

Supply channels 46 are provided at portions included in the plates 35, 36 and the vibration plate 22 and overlapping in the up-down direction with center portions in the sheet width direction of the first common channels 44 and 45. The supply channels 46 extend in the up-down direction. Lower ends of the supply channels 46 are connected to the first common channels 44 and 45. Upper ends of the supply channels 46 are connected to the ink tank 70 via channels (not depicted). A pump 71 is provided in the channel connecting each supply channel 46 and the ink tank 70. The pump 71 feeds or pumps ink from the ink tank 70 to the supply channel 46.

The vibration plate 22 is made using silicon dioxide (SiO2), silicon nitride (SiN), or the like. The vibration plate 22 is placed on an upper surface of the plate 36 and covers the pressure chambers 40. Upper ends of the connection channels 43 and upper ends of the supply channels 46 are opened in the upper surface of the vibration plate 22.

The piezoelectric elements 23 correspond to the pressure chambers 40. The piezoelectric element 23 includes a piezoelectric body 51, a lower electrode 52 (a constant potential electrode of the present disclosure), and an upper electrode 52 (a driving electrode of the present disclosure). The piezoelectric body 51 is made using a piezoelectric material that includes lead zirconate titanate as a main component. The lead zirconate titanate is a mixed crystal of lead titanate and lead zirconate. The piezoelectric body 51 is disposed at a portion included in the upper surface of the vibration plate 22 and overlapping in the up-down direction with a center portion of the pressure chamber 40.

The lower electrode 52 is common to the piezoelectric elements 23. The lower electrode 52 extends in the sheet width direction over the piezoelectric elements 23. The lower electrode 52 is disposed between the vibration plate 22 and the piezoelectric bodies 51 in the up-down direction. In the head unit 11, the lower electrode 52 extends inward in the conveyance direction beyond the piezoelectric bodies 51.

The upper electrode 53 is disposed on the upper surface of the piezoelectric body 51. In the head unit 11, each upper electrode 53 is drawn outward in the conveyance direction beyond the piezoelectric body 51 by use of a trace 57 extending over a side surface of the piezoelectric body 51 and the upper surface of the vibration plate 22.

The protection substrate 24 is disposed on the upper surface of the vibration plate 22 on which the piezoelectric elements 23 are placed. The two recesses 24*a* and the recess 24*b* are opened in the lower surface of the protection substrate 24. The two recesses 24*a* correspond to the two individual channel rows 7. The recesses 24*a* extend in the sheet width direction over the entire length of the individual channel rows 7. Each of the recesses 24*a* accommodates the piezoelectric elements 23 corresponding to one of the individual channel rows 7.

The recess 24*b* is formed in the protection substrate 24 at a portion between the two recesses 24*a* in the conveyance direction. The recess 24*b* extends in the sheet width direction over the entire length of the two individual channel rows 7. The recess 24*b* overlaps in the up-down direction with the partition wall 21*a* of the channel unit 21 and portions included in the connection channels 43 of the individual channels 20 and extending in the up-down direction. A space defined by an inner wall surface of the recess 24*b* and the upper surface of the vibration plate 22 is a second common channel 50. The second common channel 50 is connected to the upper ends of the connection channels 43 of the individual channels 20. The shape of the second common channel 50 as viewed in the sheet width direction is a rectangle that is long in the conveyance direction. Portions 50*a* that are included in the second common channel 50 and that are two corners at the upper side of the rectangle curve to be convex toward the outside of the second common channel 50.

A length H2 in the up-down direction of the recess 24*b* (second common channel 50) is longer than a length H1 in the up-down direction of the recess 24*a*. Specifically, the length H1 is approximately 100 μm and the length H2 is not less than 300 μm and not more than 350 μm. A length W in the conveyance direction of the second common channel 50 is not less than 4,000 μm and not more than 6,000 μm. As described above, although the length W in the conveyance direction of the second common channel 50 is considerably longer than the length H2 in the up-down direction, for easy understanding of FIG. 5, the head unit 11 depicted in FIG. 5 is depicted such that the ratio of the length in the up-down direction to the length in the conveyance direction is larger than an actual configuration. The length in the sheet width direction of the second common channel 50 is approximately 30 mm, for example, when the number of individual channels 20 in the head unit 11 is approximately 800 (when the number of individual channels forming each individual channel row 7 is approximately 400).

A discharge channel 47 is disposed at an upper end of the protection substrate 24 at a portion overlapping in the up-down direction with a right end in the sheet width direction of the second common channel 50. The discharge channel 47 extends in the up-down direction. A lower end of the discharge channel 47 is connected to the second common channel 50. An upper end of the discharge channel 47 is connected to the ink tank 70 via a channel (note depicted). A pump 72 is provided in the channel connecting the discharge channel 47 and the ink tank 70. The pump 72 feeds or pumps ink from the discharge channel 47 to the ink tank 70.

The protection substrate 24 includes through hole vias (THV) 61 (a common trace of the present disclosure). Each through hole via 61 is formed at portion included in a left end in the sheet width direction of the protection substrate 24, positioned between each recess 24*a* and the recess 24*b* in the conveyance direction, and overlapping in the up-down direction with the lower electrode 52. Each through hole via 61 passes through the protection substrate 24 in the up-down direction. Each through hole via 61 is positioned, in the conveyance direction, between the descender portion 41 and a portion of the connection channel 43 extending in the up-down direction. The through hole vias 61 do not overlap in the up-down direction with the individual channels 20.

The protection substrate 24 includes through hole vias 63. Each through hole via 63 is formed at a portion positioned outside the recess 24*a* in the conveyance direction and overlapping in the up-down direction with the end of the trace 57 on the opposite side to the upper electrode 53. Each through hole via 63 passes through the protection substrate 24 in the up-down direction. Lower ends of the through hole vias 63 are connected to the traces 57. In the head 11, the through hole vias 63 are positioned outside the pressure chambers 40 and the throttle portions 42 in the conveyance direction. The through hole vias 63 do not overlap in the up-down direction with the individual channels 20. In this embodiment, the through hole via 63 corresponding to the individual channels 20A corresponds to a first individual trace of the present disclosure. The through hole via 63 corresponding to the individual channels 20B corresponds to a second individual trace of the present disclosure.

The two driver ICs 65 are disposed on an upper surface of the protection substrate 24. The two driver ICs 65 correspond to two individual channel rows 7. The two driver ICs 65 extend in the sheet width direction over the entire length of the two individual channel rows 7. The driver ICs 65 overlap in the up-down direction with the through hole vias 63. The driver ICs 65 are connected to upper ends of the through hole vias 63. The driver ICs 65 selectively applies any of the ground potential and a predefined driving potential (e.g., approximately 20V) to the upper electrodes 53 via the through hole vias 63 and the traces 57.

At the left side of the discharge channel 47 in the sheet width direction, a trace member 66 is joined to the upper surface of the protection substrate 24 at a portion between the two driver ICs 65 in the conveyance direction. Connection traces 58 connecting the driver ICs 65 and the trace member 66 are disposed on the upper surface of the protection substrate 24. The driver ICs 65 are connected to a control board (not depicted) via the trace member 66.

The through hole vias 61 are positioned between the two driver ICs 65 in the conveyance direction. The through hole vias 61 do not overlap in the up-down direction with the driver ICs 65. The through hole vias 61 overlap in the up-down direction with the trace member 66. Upper ends of the through hole vias 61 are connected to the trace member 66. The through hole vias 61 are connected to a power source (not depicted) via the trace member 66. The power source keeps the lower electrode 52 at the ground potential.

Subsequently, explanation is made about a method for driving the piezoelectric element 23 to discharge ink from the nozzle 10. In the head unit 11, the upper electrodes 53 of all the piezoelectric elements 23 are kept at the ground potential in advance. When ink is discharged from a certain nozzle 10, the electric potential of the upper electrode 53 corresponding to the certain nozzle 10 is switched from the ground potential to the driving potential. The difference in electric potential between the lower electrode 52 and the upper electrode 53 generates an electric field in a thickness direction at a portion interposed between the electrodes of the piezoelectric body 51. This electric field contracts the portion of the piezoelectric body 51 in a horizontal direction. This deforms a portion of the piezoelectric body 51 and the vibration plate 22 overlapping in the up-down direction with the pressure chamber 40 so that the portion becomes convex toward the pressure chamber 40, thus decreasing the volume of the pressure chamber 40. As a result, the pressure of ink in the pressure chamber 40 increases, discharging ink from the nozzle 10 communicating with the pressure chamber 40.

Subsequently, ink circulation between the head unit 11 and the ink tank 70 is explained. When ink is fed by the pumps 71 and 72 as described above, ink in the ink tank 70 flows into the first common channels 44 and 45 via the supply channels 46. The ink in the first common channels 44 and 45 flows into the individual channels 20 through the throttle portions 42. Ink in the individual channels 20 flows into the second common channel 50 through the connection channels 43. Ink in the second common channel 50 is discharged through the discharge channel 47 and returns to the ink tank 70. This allows ink to circulate between the head unit 11 and the ink tank 70.

Effect of Embodiment

Unlike this embodiment, the second common channel may be formed in the channel unit 21. In that configuration, the channel unit 21 has spaces corresponding to the first common channels and a space corresponding to the second common channel. This reduces the rigidity of the channel unit 21, and thus the channel unit 21 is easily damaged.

In this embodiment, the first common channels 44 and 45 are formed in the channel unit 21, and the second common channel 50 is formed in the protection substrate 24 (i.e., the second common channel 50 is not formed in the channel unit 21). This increases the rigidity of the channel unit 21, inhibiting the channel unit 21 from being damaged. The length in the up-down direction of the protection substrate 24 may be longer than the length H1 in the up-down direction of the recesses 24*a* covering the piezoelectric elements 23. In that configuration, even when the recess 24*b* corresponding to the second common channel 50 is formed in the protection substrate 24, the rigidity of the protection substrate 24 is not likely to be greatly decreased, thus inhibiting the damage in the protection substrate 24.

In this embodiment, the portion of the channel unit 21 (plates 33 to 36) overlapping in the up-down direction with the second common channel 50 is the wall 21*a* separating the individual channels 20A from the individual channels 20B. This increases the rigidity of the channel unit 21 compared to a case in which the second common channel 50 is formed in the wall 21*a* of the channel unit 21.

In this embodiment, the pumps 71 and 72 are driven to feed ink from the ink tank 70 to the first common channels 44 and 45, and ink returns to the ink tank 70 through the second common channel 50. Ink thus can circulate between the ink tank 70 and each head unit 11.

In this embodiment, the connection channel 43 connects the lower end of the descender portion 41 and the second communication channel 50. This allows bubbles entering the descender portion 41 through the nozzle 10 to be discharged to the second common channel 50 effectively.

In this embodiment, the portions of the connection channels 43 extending in the up-down direction overlap in the up-down direction with the second common channel 50. This makes the head unit 11 small in the conveyance direction compared to a case in which the connection channels do not overlap in the up-down direction with the second common channel 50.

In this embodiment, an inner wall surface on the lower side of the second common channel 50 is formed by the upper surface of the vibration plate 22. This makes the second common channel 50 long in the up-down direction, thus increasing the volume of the second common channel 50 compared to a case in which the inner wall surface on the lower side of the second common channel 50 is formed on the protection substrate 24.

In this embodiment, the protection substrate 24 is placed on the upper surface of the vibration plate 22, and the driver ICs 65 are placed on the upper surface of the protection substrate 24. The through hole vias 63 are placed on the protection substrate 24. Accordingly, the upper electrodes 53 of the piezoelectric elements 23 placed on the vibration plate 22 are connected to the driver ICs 65 placed on the upper surface of the protection substrate 24 via the through hole vias 63.

Unlike the head unit 11 of this embodiment, the traces 57 connected to the upper electrodes 53 may be drawn inward in the conveyance direction, and the lower electrode 52 may be drawn outward in the conveyance direction. In that case, the through hole via 63 corresponding to the individual channel row 7A and the through hole via 63 corresponding to the individual channel row 7B are arranged close to each other in an area between the piezoelectric elements 23 corresponding to the individual channel row 7A and the piezoelectric elements 23 corresponding to the individual channel row 7B in the conveyance direction. This easily causes a short circuit.

In the head unit 11 of this embodiment, the lower electrode 52 is drawn inward in the conveyance direction. Namely, the through hole vias 61 are arranged between the piezoelectric elements 23 corresponding to the individual channel row 7A and the piezoelectric elements 23 corresponding to the individual channel row 7B in the conveyance direction. In the head unit 11, the traces 57 connected to the upper electrodes 53 are drawn outward in the conveyance direction. Namely, the through hole via 63 corresponding to the individual channel row 7A is placed farther from the individual channel row 7B in the conveyance direction than the piezoelectric elements 23 corresponding to the individual channel row 7A. The through hole via 63 corresponding to the individual channel row 7B is placed farther from the individual channel row 7A in the conveyance direction than the piezoelectric elements 23 corresponding to the individual channel row 7B. This sufficiently separates the through hole via 63 corresponding to the individual channel row 7A from the through hole via 63 corresponding to the individual channel row 7B. This thus inhibits a short circuit between the through hole vias 63.

In this embodiment, the through hole vias 61 are placed at a portion included in the protection substrate 24 and positioned between the piezoelectric element 23 and the second common channel 50 in the conveyance direction. This allows each through hole via 61 to be placed in an area not including the second common channel 50.

In this embodiment, the through hole vias 61 are placed on both side in the conveyance direction of the second common channel 50. This makes the traces connected to the lower electrode 52 large, thus stabilizing the electric potential of the lower electrode 52 kept at the ground potential.

In this embodiment, the discharge channel 47 is placed at the right end in the sheet width direction of the protection substrate 24, and the through hole vias 61 are placed at the left end in the sheet width direction of the protection substrate 24. This sufficiently separates the discharge channel 47 from the through hole vias 61. Even when ink leaks from the discharge channel 47, a short circuit between the through hole vias 61 and other traces would be inhibited.

In this embodiment, in order to connect the through hole vias 61 and the lower electrode 51 and to connect the through hole vias 63 and the traces 57, the portions of the protection substrate 24 where the through hole vias 61 and 63 are arranged are required to be pressed against the channel unit 21 with pressure, when the channel unit 21 is joined to the protection substrate 24. In this embodiment, the through hole vias 61 and 63 do not overlap in the up-down direction with the individual channels 20. The channel substrate 21 is thus not likely to be damaged even when pressure is applied thereto from the portions of the protection substrate 21 where the through hole vias 61 and 63 are arranged.

In this embodiment, the trace member 66 is disposed at a portion included in the upper surface of the protection substrate 24 and positioned on the left in the sheet width direction of the discharge channel 47. Thus, the trace member 66 does not interfere with the discharge channel 47.

In the protection substrate 24 of this embodiment, the length H2 in the up-down direction of the recess 24*b* corresponding to the second common channel 50 is longer than the length H1 in the up-down direction of the recesses 24*a* covering the piezoelectric elements 23. This makes the length in the up-down direction of the second common channel 50 long, thus making the volume of the second common channel 50 large.

In this embodiment, the length H2 in the up-down direction of the second common channel 50 is not less than 300 μm and not more than 350 μm, and the length in the conveyance direction of the second common channel 50 is not less than 4,000 μm and not more than 6,000 μm. The inventors calculated a channel width that makes pressure loss not more than 4.0 kPa when the channel depth is 0.3 mm, and a channel width that makes pressure loss not more than 4.0 kPa when the channel depth is 0.5 mm, assuming that the withstanding pressure of meniscus of ink in the nozzle 10 is approximately 4 kPa. The calculation was performed on the assumption that the number of the individual channels 20 in the head unit 11 was 800 (the number of the individual channels 20 forming each individual channel row 7 was 400), that the volume of ink discharged from the nozzle 10 was 16 pl, and that the driving frequency of the head unit 11 was 20 kHz. As a result, it is revealed that when the channel depth is 0.3 mm, the channel width is required to be not less than 4 mm in order to make the pressure loss not more than 4.0 kPa, and that when the channel depth is 0.5 mm, the channel width is required to be not less than 1.145 mm in order to make the pressure loss not more than 4.0 kPa.

A portion of the protection substrate 24 formed having a channel (hereinafter referred to as a channel portion) is thinner than a portion of the protection substrate 24 formed having no channel. The inventors revealed through the calculation that, when the protection substrate 24 is a silicon substrate, the ratio (width/thickness) of the width of the channel formed in the protection substrate 24 to the thickness of the channel portion is required to be not less than 18 in order that that the channel portion can withstand a pressure of 100 N, and the ratio is required to be not less than 15 in order that the channel portion can withstand a pressure of 200 N. It is thus revealed that, when the channel width is 4 mm, the thickness of the channel portion is required to be not less than 0.22 mm in order that the channel portion can withstand a pressure of 100 N, and the thickness of the channel portion is required to be not less than 0.32 mm in order that the channel portion can withstand a pressure of 200 N. Further, when the channel width is 1.145 mm, the thickness of the channel portion is required to be not less than 0.06 mm in order that the channel portion can withstand a pressure of 100 N, and the thickness of the channel portion is required to be not less than 0.09 mm in order that the channel portion can withstand a pressure of 200 N.

As described above, when the channel depth is 0.3 mm, the channel width is required to be not less than 4 mm in order to make the pressure loss not more than 4.0 kPa. Here, the thickness of the channel portion is required to be not less than 0.22 mm in order that the channel portion can withstand a pressure of 100 N. The thickness of the protection substrate 24 is thus required to be not less than 0.52 mm. The thickness of the channel portion is required to be not less than 0.32 mm in order that the channel portion can withstand a pressure of 200 N. The thickness of the protection substrate 24 is thus required to be not less than 0.62 mm. When the channel depth is 0.5 mm, the channel width is required to be not less than 1.145 mm in order that the pressure loss is not more than 4.0 kPa. Here, the thickness of the channel portion is required to be not less than 0.06 mm in order that the channel portion can withstand a pressure of 100 N. The thickness of the protection substrate 24 is thus required to be not less than 0.56 mm. The thickness of the channel portion is required to be not less than 0.09 mm in order that the channel portion can withstand a pressure of 200 N. The thickness of the protection substrate 24 is thus required to be not less than 0.59 mm.

The second common channel 50 having the above size can have a volume required to discharge ink from the nozzle 10 appropriately, for example, when the withstanding pressure of meniscus of ink in the nozzle 10 is approximately 4 kPa, when the number of the individual channels 20 in the head unit 11 is approximately 800 (the number of the individual channels 20 forming each individual channel row 7 is approximately 400), when the volume of ink discharged from the nozzle 10 is approximately 16 pl, and when the driving frequency of the head unit 11 is approximately 20 kHz.

In this embodiment, the shape of the second common channel 50 as viewed in the sheet width direction is a rectangle. The portions 50*a* that are included in the inner wall surface of the second common channel 50 and are the two corners at the upper side of the rectangle curve to be convex toward the outside of the second common channel 50. Bubbles are thus not likely to be accumulated in the portions 50*a* of the second common channel 50.

Modified Embodiments

The embodiment of the present disclosure is explained above. The present disclosure, however, is not limited to the above embodiment. Various changes or modifications may be made without departing from the claims.

In the above embodiment, the shape of the second common channel 50 as viewed in the sheet width direction is a rectangle, and the portions 50*a* of the second common channel 50 that are the corners of the rectangle curve to be convex toward the outside of the second common channel 50. The present disclosure, however, is not limited thereto. The portions of the second common channel 50 that are the corners of the rectangle may be bent instead of curved. The shape of the second common channel 50 as viewed in the sheet width direction may be any other shape than the rectangle.

In the above embodiment, the length H2 in the up-down direction of the second common channel 50 is not less than 300 μm and not more than 350 μm, and the length W in the conveyance direction of the second common channel 50 is not less than 4,000 μm and not more than 6,000 μm. The present disclosure, however, is not limited thereto. For example, the length H2 in the up-down direction of the second common channel 50 may be longer than 350 μm, and the length W in the conveyance direction of the second common channel 50 may be longer than 6,000 μm.

The length H2 in the up-down direction of the second common channel 50 may be less than 300 μm and the length W in the conveyance direction of the second common channel 50 may be less than 4,000 μm, provided that ink can be discharged appropriately from the nozzle 10.

In the above embodiment, the trace member 66 is disposed at a portion included in the upper surface of the protection substrate 24 and different from the portion where the discharge channel 47 is disposed. The driver ICs 65 are connected to the trace member 66 via the connection traces 58 disposed on the upper surface of the protection substrate 24. The present disclosure, however, is not limited thereto. For example, the trace member may be disposed at a portion of the upper surface of the vibration plate 22 where the protection substrate 24 and the supply channels 46 are not disposed.

In the above embodiment, the through hole vias 61 and 63 do not overlap in the up-down direction with the individual channels 20. The present disclosure, however, is not limited thereto. The through hole vias may overlap in the up-down direction with the individual channels 20.

In the above embodiment, the discharge channel 47 is disposed at the right end in the sheet width direction of the protection substrate 24, and the through hole vias 61 are disposed at the left end in the sheet width direction of the protection substrate 24. The present disclosure, however, is not limited thereto. The discharge channel may be disposed at the left end in the sheet width direction of the protection substrate 24, and the through hole vias may be disposed at the right end in the sheet width direction of the protection substrate 24. Or, if the discharge channel does not interfere with the through hole vias, the discharge channel and the through hole vias may be disposed at the same side in the sheet width direction of the protection substrate 24. Further, at least one of the discharge channel and the through hole vias may be disposed in any other portion than the ends in the sheet width direction of the protection substrate 24.

In the above embodiment, the through hole vias 61 are disposed at both sides in the conveyance direction of the second common channel 50. The present disclosure, however, is not limited thereto. For example, the lower electrode 52 corresponding to the individual channel row 7A may be connected to the lower electrode 52 corresponding to the individual channel row 7B on the upper surface of the vibration plate 22. In that case, the through hole vias 61 may be disposed at only one side in the conveyance direction of the second common channel 50.

The through hole vias 61 may not be disposed at the portions included in the protection substrate 24 and between the recesses 24*a* (piezoelectric elements 23) and the recess 24*b* (second common channel 50) in the conveyance direction. The through hole vias 61 may be disposed in any other portions of the protection substrate 24 than the portions between the recesses 24*a* and the recess 24*b* in the conveyance direction.

In the head unit 11 of the above embodiment, the lower electrode 52 is drawn inward in the conveyance direction, and the upper electrodes 53 are drawn outward in the conveyance direction. The present disclosure, however, is not limited thereto.

Figure 6:
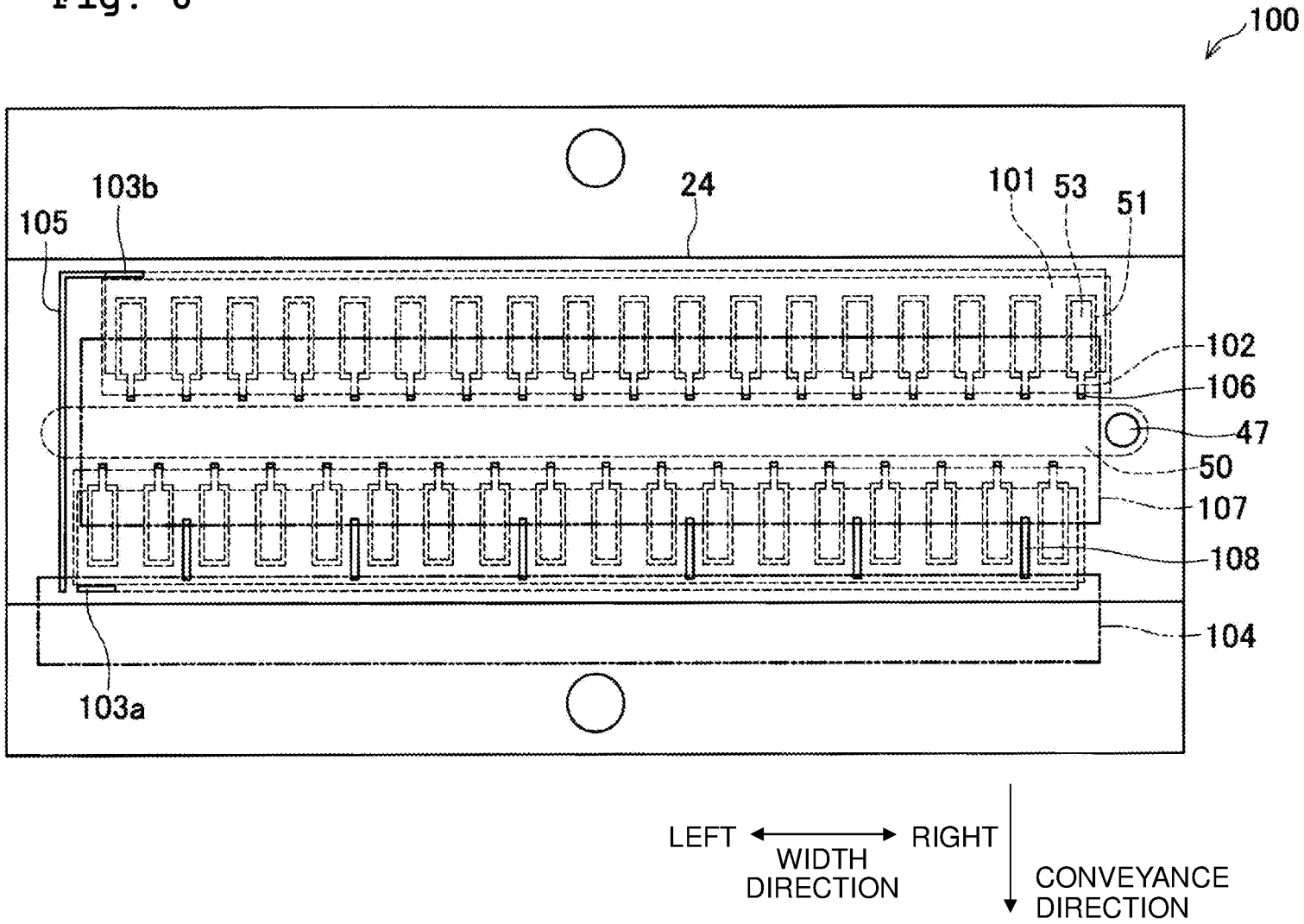
FIG. 6 is a plan view of a head unit 100 which corresponds to FIG. 2.
Figure 7:
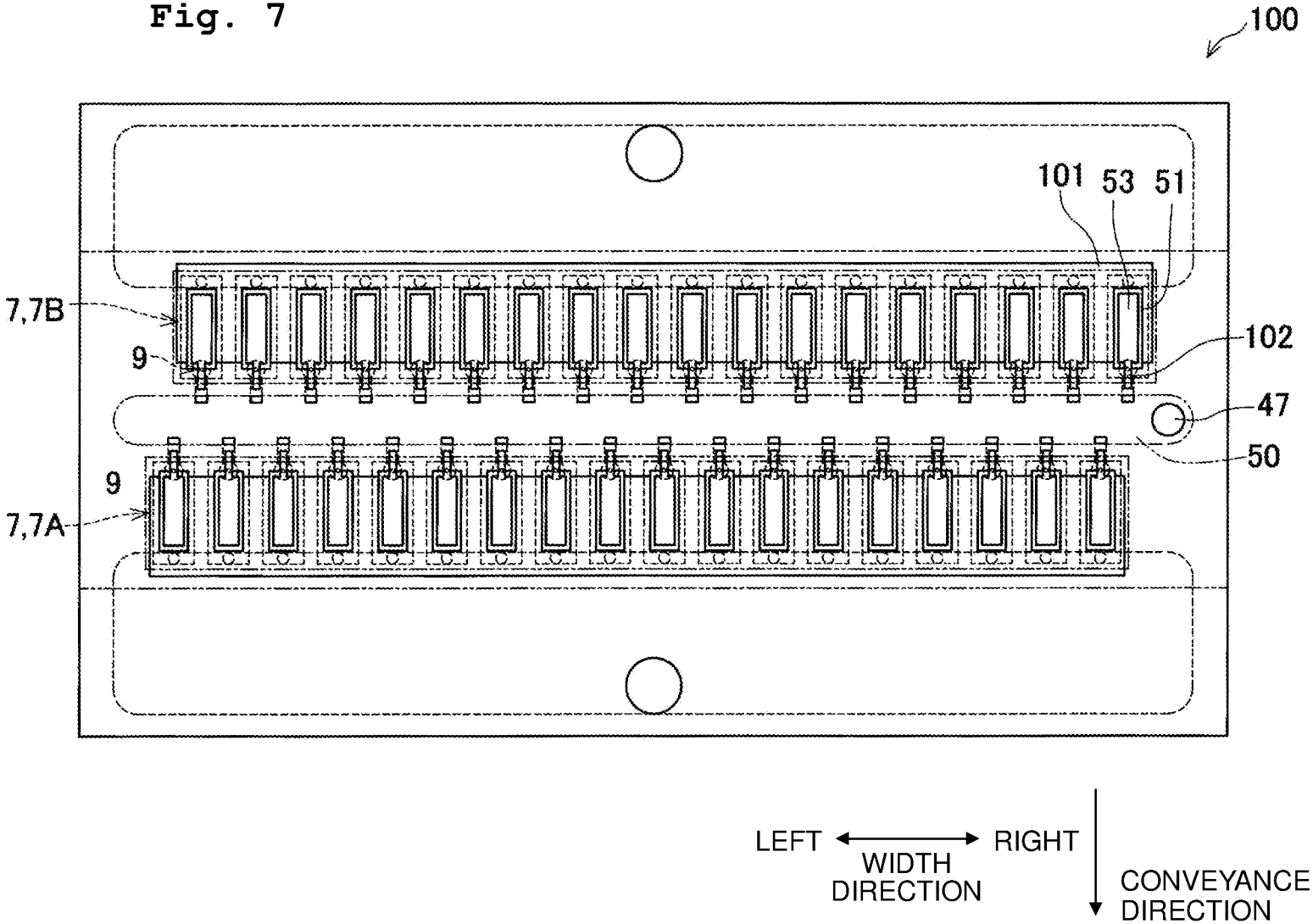
FIG. 7 is a plan view of the head unit 100 which corresponds to FIG. 3.
Figure 8:
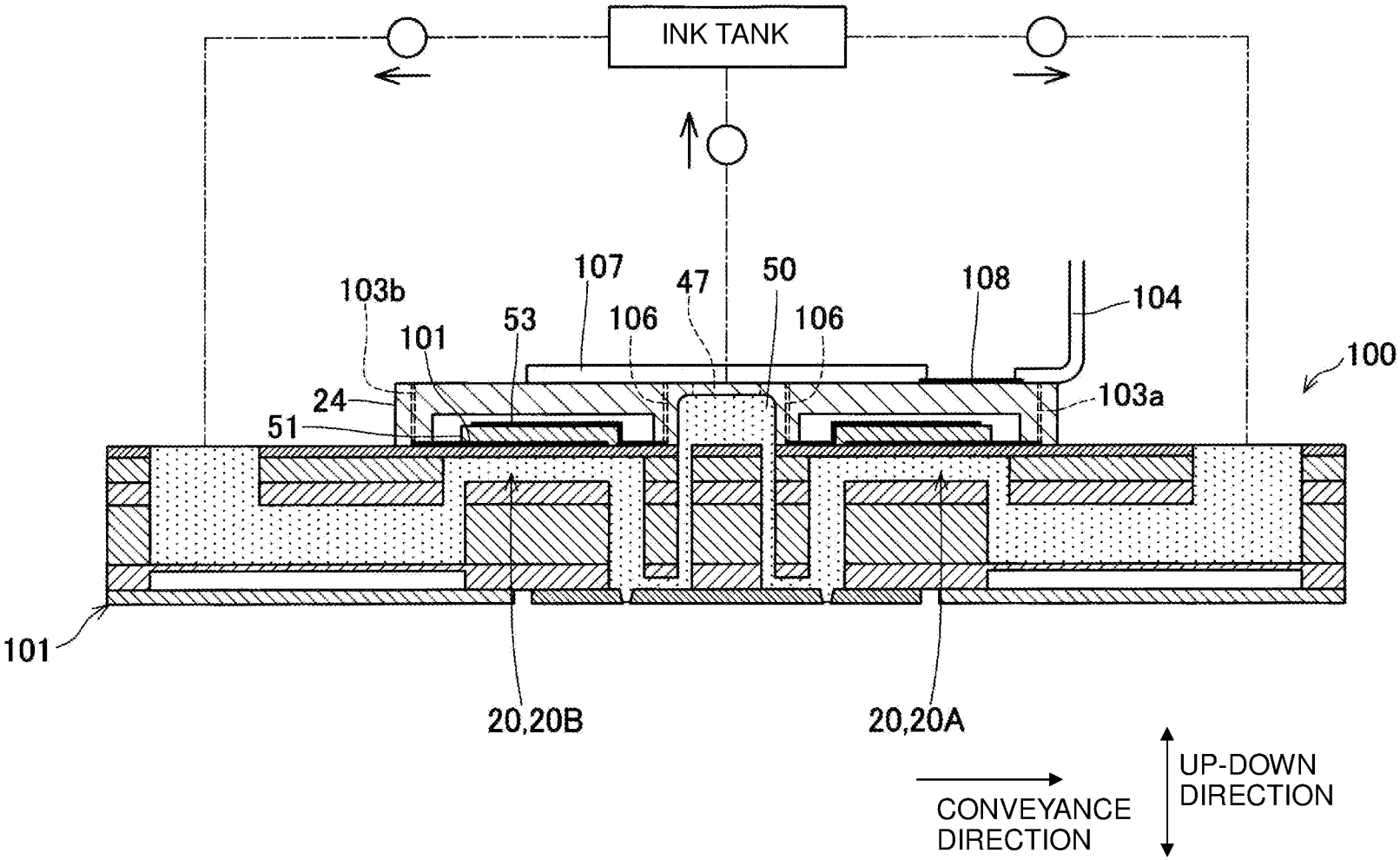
FIG. 8 is a cross-sectional view of the head unit 100 which corresponds to FIG. 5.

For example, in the first modified embodiment, lower electrodes 101 in a head unit 100 extend outward in the conveyance direction beyond areas where the piezoelectric bodies 51 are disposed, as depicted in FIGS. 6 to 8. In the head unit 100, traces 102 connected to the upper electrodes 53 are drawn inward in the conveyance direction beyond the areas where the piezoelectric bodies 51 are disposed.

The lower electrode 101 corresponding to the individual channel row 7A is connected to a through hole via 103*a* (a common trace of the present disclosure) that passes through, in the up-down direction, an end positioned at a left side in the sheet width direction and positioned downstream in the conveyance direction of the protection substrate 24. A trace member 104 is joined to a downstream end in the conveyance direction of the upper surface of the protection substrate 24. An upper end of the through hole via 103*a* is connected to the trace member 104.

The lower electrode 101 corresponding to the individual channel row 7B is connected to a through hole via 103*b* (a common trace of the present disclosure) that passes through, in the up-down direction, an end positioned at the left side in the sheet width direction and positioned upstream in the conveyance direction of the protection substrate 24. The through hole via 103*b* is connected to a trace 105 on the upper surface of the protection substrate 24. The trace 105 extends to the downstream end in the conveyance direction of the protection substrate 24 and is connected to the trace member 104.

The traces 102 are connected to through hole vias 106 (an individual trace of the present disclosure) that pass through the protection substrate 24 in the up-down direction. A driver IC 107 is disposed on the upper surface of the protection substrate 24 at a portion included in a portion overlapping in the up-down direction with the second common channel 50 and positioned at the left of the discharge channel 47 in the sheet width direction. The driver IC 107 is connected to upper ends of the through hole vias 106. The driver IC 107 is connected to the trace member 104 via connection traces 108 disposed on the upper surface of the protection substrate 24.

In the first modified embodiment, the driver IC 107 overlaps in the up-down direction with the second common channel 50. Ink flowing through the second common channel 50 thus cools the heat generated in the driver IC 107.

In the above embodiment(s), the driver IC is disposed on the upper surface of the protection substrate 24, and the driver IC is connected to the electrodes of the piezoelectric elements via the through hole vias passing through the protection substrate 24 in the up-down direction. The present disclosure, however, is not limited thereto. For example, the trace member may be a Chip on Film (COF) on which the driver IC is mounted. Or, the lower electrode(s) and the upper electrodes may be drawn on the upper surface of the vibration plate 22, and the trace member may be joined to the upper surface of the vibration plate 22.

In the above embodiment, the connection channels 43 overlap in the up-down direction with the second common channel 50. The present disclosure, however, is not limited thereto. The connection channels may not overlap in the up-down direction with the second connection channel. For example, the connection channels may be connected to the second common channel from the conveyance direction.

In the above embodiment, the connection channels 43 connect the lower ends of the descender portions 41 and the second common channel 50. The present disclosure, however, is not limited thereto. For example, the connection channels may connect any other portions of the descender portions 41 than the lower ends and the second common channel 50.

Figure 9:
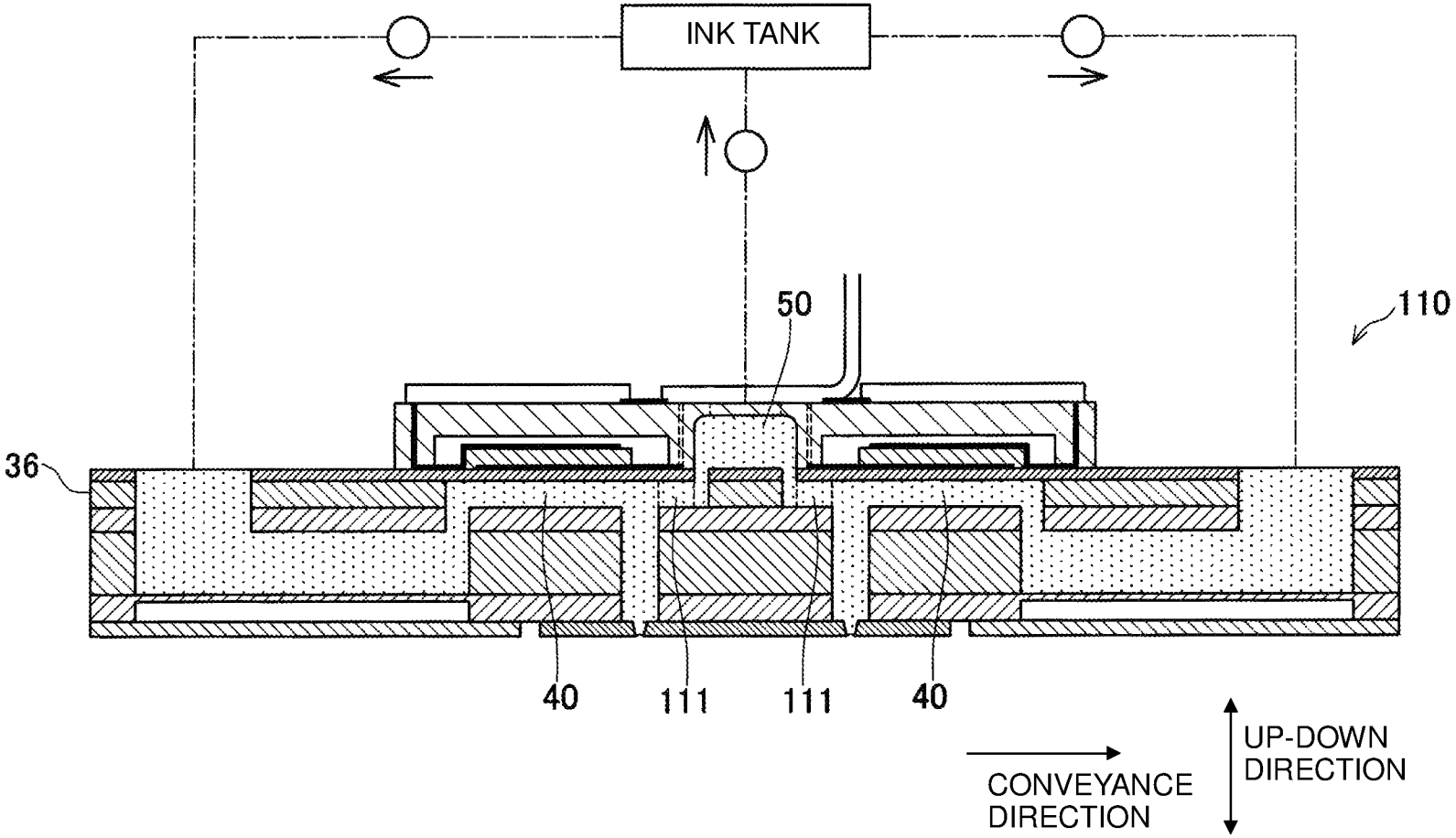
FIG. 9 is a cross-sectional view of a head unit 110 which corresponds to FIG. 5.

The connection channels 43 may not be connected to the descender portions 41. For example, in a head unit 110 of the second modified embodiment, connection channels 111 are formed in the plate 36, as depicted in FIG. 9. Each connection channel 111 is connected to an end at a nozzle 10 side in the conveyance direction of the pressure chamber 40. In the head unit 110, the connection channels 111 extend inward in the conveyance direction. The connection channels 111 are bent upward, and upper ends of the connection channels 111 are connected to the second common channel 50.

In the second modified embodiment, bubbles in the pressure chambers 40 are discharged efficiently from the connection channels 111 to the second common channel 50.

In the above embodiment(s), all the portions of the connection channels connecting the individual channels 20 and the second common channel 50 correspond to the individual channels 20. The present disclosure, however, is not limited thereto. For example, the connection channels connecting the individual channels 20 and the second common channel may be channels including channel portions respectively connected to the individual channels 20 and a channel portion that is common to the individual channels 20 and connects the channel portions and the second common channel.

The ink flowing direction in which ink circulates between the head unit and the ink tank may be reversed to that described above. For example, the ink flowing direction may be reversed by reversing all the directions in which ink is fed by the pumps 71 and 72 in the above embodiment.

Further, ink may not circulate between the head unit and the ink tank. For example, no pump may be provided between the head unit and the ink tank. In that case, when ink is discharged from the nozzle, not only ink in the first common channel flows from the throttle portion into the individual channel, but also ink in the second common channel flows into the individual channel via the connection channel.

In the above embodiment(s), the driving element that applies pressure to ink in the pressure chamber is the piezoelectric element having the piezoelectric body and the electrodes. The present disclosure, however, is not limited thereto. Pressure may be applied to ink in the pressure chamber by any other driving element than the piezoelectric element.

The examples in which the present disclosure is applied to the ink-jet head (head unit) discharging ink from nozzles are explained above. The present disclosure, however, is not limited thereto. The present disclosure can be applied to a liquid discharge head discharging any other liquid than ink from nozzles.

What is claimed is:

1. A liquid discharge head, comprising:

a channel member including:

a plurality of individual channels that include a plurality of nozzles and a plurality of pressure chambers communicating with the nozzles; and at least part of a first common channel communicating with the individual channels;

a vibration plate overlapping in a first direction with the channel member and covering the pressure chambers that form the individual channels;

a plurality of driving elements placed on a surface of the vibration plate at a side opposite to the pressure chambers in the first direction and configured to apply pressure to a liquid in the pressure chambers; and a protection substrate disposed on the surface of the vibration plate, where the driving elements are placed, at the side opposite to the pressure chambers in the first direction and covering the driving elements, wherein the protection substrate includes a second common channel that is common to the individual channels and that is located in the protection substrate, and wherein the channel member includes a connection channel connecting the individual channels and the second common channel.

2. The liquid discharge head according to claim 1, wherein the first common channel is a channel through which the liquid flows into the individual channels, and wherein the second common channel is a channel through which the liquid flows out of the individual channels.

3. The liquid discharge head according to claim 2, wherein the nozzles overlap in the first direction with the pressure chambers, wherein the individual channels include a plurality of descender portions extending in the first direction and connecting the nozzles and the pressure chambers, and wherein the connection channel connects ends at a side of the nozzles in the first direction of the descender portions and the second common channel.

4. The liquid discharge head according to claim 2, wherein the connection channel connects the pressure chambers and the second common channel.

5. The liquid discharge head according to claim 1, wherein the connection channel overlaps in the first direction with the second common channel.

6. The liquid discharge head according to claim 1, wherein an inner wall surface at a side of the vibration plate in the first direction of the second common channel is formed by a surface at a side of the protection substrate in the first direction of the vibration plate.

7. The liquid discharge head according to claim 1, further comprising a driver IC configured to drive the driving elements, wherein the driver IC is disposed at a portion included in a surface of the protection substrate at a side opposite to the channel member in the first direction and overlapping in the first direction with the second common channel.

8. The liquid discharge head according to claim 7, further comprising:

a common connection channel that is opened in the surface of the protection substrate at the side opposite to the channel member in the first direction and is connected to the second common channel;

a trace member connected to a portion included in the surface of the protection substrate at the side opposite to the channel member in the first direction and different from a portion formed having the common connection channel; and a connection trace disposed on the surface of the protection substrate at the side opposite to the channel member in the first direction and connecting the driver IC and the trace member.

9. The liquid discharge head according to claim 1, further comprising:

a driver IC disposed on a surface of the protection substrate at a side opposite to the channel member in the first direction and configured to drive the driving elements; and a plurality of traces connecting the driving elements and the driver IC and including a plurality of through hole vias passing through the protection substrate in the first direction.

10. The liquid discharge head according to claim 9, wherein the individual channels form a first individual channel row and a second individual channel row extending in a second direction that is orthogonal to the first direction, the first individual channel row and the second individual channel row being arranged in a third direction that is orthogonal to the first direction and the second direction, each of the driving elements includes:

a constant potential electrode held at a predefined constant potential; and a driving electrode by which an electric potential of each of the driving elements is switched, the through hole vias include:

a common trace disposed between the driving elements corresponding to the first individual channel row and the driving elements corresponding to the second individual channel row in the third direction, and connected to the constant potential electrode;

a first individual trace disposed farther from the second individual channel row in the third direction than the driving elements corresponding to the first individual channel row, and connecting the driving electrodes of the driving elements corresponding to the first individual channel row and the driver IC; and a second individual trace disposed farther from the first individual channel row in the third direction than the driving elements corresponding to the second individual channel row, and connecting the driving electrodes of the driving elements corresponding to the second individual channel row and the driver IC.

11. The liquid discharge head according to claim 10, wherein the common trace is disposed at a portion included in the protection substrate and positioned between the driving elements and the second common channel in the third direction.

12. The liquid discharge head according to claim 11, wherein the common trace includes a plurality of common traces, and the common traces are disposed at both sides of the second common channel in the third direction.

13. The liquid discharge head according to claim 10, further comprising a common connection channel disposed at an end on a first side in the second direction of the protection substrate and connected to the second common channel, wherein the common trace is disposed at an end on a second end side in the second direction of the protection substrate.

14. The liquid discharge head according to claim 10, wherein the channel member includes a wall separating the individual channels forming the first individual channel row from the individual channels forming the second individual channel row at a portion positioned between the first individual channel row and the second individual channel row in the third direction and overlapping in the first direction with the second common channel.

15. The liquid discharge head according to claim 9, wherein the through hole vias do not overlap in the first direction with the individual channels.

16. The liquid discharge head according to claim 1, wherein an entirety of the second common channel is formed in the protection substrate.

17. The liquid discharge head according to claim 1, wherein the protection substrate includes a first recess that is opened at a side of the vibration plate in the first direction and accommodates the driving elements, and a second recess that is opened at the side of the vibration plate in the first direction and that is to be the second common channel, the second recess being longer in the first direction than the first recess.

18. The liquid discharge head according to claim 1, wherein the individual channels are arranged in a second direction that is orthogonal to the first direction, and wherein the second common channel extends in the second direction, has a length in the first direction of not less than 300 μm, and has a length in a third direction, which is orthogonal to the first direction and the second direction, of not less than 4,000 μm.

19. The liquid discharge head according to claim 18, wherein the second common channel has a length in the first direction of not more than 350 μm and a length in the third direction of not more than 6,000 μm.

20. The liquid discharge head according to claim 1, wherein the individual channels are arranged in a second direction that is orthogonal to the first direction, wherein the second common channel extends in the second direction, and a shape of the second common channel as viewed in the second direction is a rectangle, and wherein a portion included in an inner wall of the second common channel and forming a corner of the rectangle curves to be convex toward an outside of the second common channel.

* * * * *